US010480865B2

(12) United States Patent
Rice

(10) Patent No.: US 10,480,865 B2
(45) Date of Patent: Nov. 19, 2019

(54) INTERMITTENT THERMOSYPHON

(71) Applicant: J R Thermal LLC, Austin, TX (US)

(72) Inventor: Jeremy Rice, Austin, TX (US)

(73) Assignee: J R Thermal LLC, Austin, TX (US)

( * ) Notice: Subject to any disclaimer, the term of this patent is extended or adjusted under 35 U.S.C. 154(b) by 0 days.

(21) Appl. No.: 15/048,367

(22) Filed: Feb. 19, 2016

(65) Prior Publication Data

US 2016/0245593 A1 Aug. 25, 2016

Related U.S. Application Data

(60) Provisional application No. 62/118,144, filed on Feb. 19, 2015.

(51) Int. Cl.

| | |
|---|---|
| ***F28D 15/02*** | (2006.01) |
| ***F28F 13/06*** | (2006.01) |
| ***F28F 3/02*** | (2006.01) |
| ***F28D 15/04*** | (2006.01) |

(52) U.S. Cl.

CPC ..... *F28D 15/0266* (2013.01); *F28D 15/0233* (2013.01); *F28D 15/0275* (2013.01); *F28D 15/046* (2013.01); *F28F 3/025* (2013.01); *F28F 13/06* (2013.01)

(58) Field of Classification Search

CPC ..... F28F 3/044; F28F 2009/222; F28F 2009/224; F28F 3/025; F28F 13/06; F28D 9/0068; F28D 15/0266; F28D 15/046; F28D 15/0233; F28D 15/0275

See application file for complete search history.

(56) References Cited

U.S. PATENT DOCUMENTS

| | | | | |
|---|---|---|---|---|
| 3,229,764 A * | 1/1966 | Ware | F28D 9/0068 165/167 |
| 3,372,743 A | 3/1968 | Pall et al. | |
| 3,965,970 A | 6/1976 | Chisholm | |
| 4,646,815 A * | 3/1987 | Iwata | F28D 1/0308 165/170 |

(Continued)

FOREIGN PATENT DOCUMENTS

| | | |
|---|---|---|
| JP | 2005-147572 A | 6/2006 |
| JP | 2008249314 A * | 10/2008 |

(Continued)

OTHER PUBLICATIONS

International Search Report and Written Opinion issued in corresponding International Application No. PCT/US2016/018696 dated May 12, 2016.

*Primary Examiner* — Devon Russell

(74) *Attorney, Agent, or Firm* — DuBois, Bryant & Campbell, LLP; William D. Wiese

(57) ABSTRACT

The device and methods described herein relate to the isothermal heat transport through an intermittent liquid supply to an evaporator device, thereby enabling high evaporative heat transfer coefficients. A liquid and vapor mixture flows through miniature and micro-channels in an evaporator and addresses flow instabilities encountered in these channels as bubbles rapidly expand. Additionally, a high percentage of the fins are exposed to vapor and limit the required charge of refrigerant within the system due to effective condensate removal in the condenser.

19 Claims, 16 Drawing Sheets

(56) References Cited

U.S. PATENT DOCUMENTS 5,441,106 A * 8/1995 Yukitake ..... F28D 1/0391 165/177
5,940,270 A * 8/1999 Puckett ..... F28D 15/0266 165/104.33
6,148,635 A * 11/2000 Beebe ..... F04B 43/043 165/80.2
6,337,794 B1 * 1/2002 Agonafer ..... H01L 23/473 174/259
6,340,053 B1 * 1/2002 Wu ..... F28D 9/0012 165/140
6,578,626 B1 * 6/2003 Calaman ..... F28F 3/022 165/170
6,962,194 B2 * 11/2005 Martin ..... B23K 1/0012 165/170
7,219,720 B2 * 5/2007 Wakita ..... B23P 15/26 165/153
7,980,295 B2 * 7/2011 Takamatsu ..... F28D 15/043 165/104.26
8,550,153 B2 * 10/2013 Yin ..... F22B 27/00 165/146
9,297,589 B2 * 3/2016 Sakamoto ..... F28D 15/0266
2003/0164233 A1 * 9/2003 Wu ..... F28D 1/0308 165/166
2004/0065111 A1 * 4/2004 Monfarad ..... F25B 1/00 62/498
2004/0069474 A1 * 4/2004 Wu ..... F28D 1/0308 165/170
2004/0112585 A1 * 6/2004 Goodson ..... F04B 19/006 165/299
2005/0115701 A1 * 6/2005 Martin ..... F28F 13/12 165/170
2007/0012430 A1 * 1/2007 Duke ..... F28F 3/027 165/109.1
2007/0272392 A1 * 11/2007 Ghosh ..... H01L 23/4336 165/80.4
2008/0164010 A1 7/2008 Kang et al.
2009/0084525 A1 * 4/2009 Satou ..... F28D 15/0266 165/104.21
2010/0326627 A1 * 12/2010 Schon ..... F28D 15/0266 165/104.21
2011/0023518 A1 * 2/2011 Amaya ..... F28D 7/0041 62/304
2012/0175094 A1 * 7/2012 Rice ..... F28D 1/03 165/170
2013/0025826 A1 * 1/2013 Sakamoto ..... F28D 15/0266 165/104.21
2013/0219954 A1 * 8/2013 Chiba ..... H01L 23/427 62/513
2013/0319639 A1 * 12/2013 Sakamoto ..... F28D 15/0266 165/104.29
2014/0090814 A1 * 4/2014 Kondou ..... F28D 15/02 165/104.21
2014/0165638 A1 * 6/2014 Yoshikawa ..... F28D 15/0266 62/259.2
2014/0331709 A1 * 11/2014 Chiba ..... F28D 15/02 62/404

FOREIGN PATENT DOCUMENTS

JP 2012229909 A * 11/2012
WO 2009048225 A2 4/2009

* cited by examiner

INTERMITTENT THERMOSYPHON

PRIORITY STATEMENT UNDER 35 U.S.C. § 119 & 37 C.F.R. § 1.78

This non-provisional application claims priority based upon prior U.S. Provisional Patent Application Ser. No. 62/118,144 filed Feb. 19, 2015 in the name of Jeremy Rice entitled "Intermittent Thermosyphon," the disclosure of which is incorporated herein in its entirety by reference as if fully set forth herein.

BACKGROUND OF THE INVENTION

Passive heat transfer devices, such as heat pipes, are of much interest in applications such as electronics cooling. Heat pipes are a liquid and vapor device in which liquid is pumped through capillarity from the condenser to the evaporator. The pumping effect in this device requires a wick, which produces a high pressure loss and limits the maximum heat transport distance and or power that can be supported before dry-out occurs.

Another technology node that is useful is a thermosyphon as shown in FIG. 1. In operation, liquid 104 is vaporized in an evaporator 101. The vapor then travels through a tube 102 to the condenser 100. Heat is removed from the condenser 100 causing the liquid 104 to accumulate at the bottom. The accumulated liquid 104 in the condenser is driven by gravity through a liquid line 103 back to the evaporator 101. The evaporators in these devices are typically pool boiling devices with an enhanced surface 105 that may consist of fins, a porous layer or even an etched surface. The maximum boiling heat transfer coefficient can be limited in this device because there are a finite amount of nucleation sites, and therefore a limited length of solid/liquid/vapor contact, where the heat transfer rate is the highest.

In conventional thermosyphon design, a flow pattern that enters one side of the evaporator and leaves the other side, through a series of channels is typically not used. While this general concept is widely used in most heat transfer products, the implementation in thermosyphon design for electronics is generally prohibited by the limited pressure head provided by gravity to drive the flow and flow instabilities encountered with vapor expansion in a confined channel as shown in FIG. 2. As a channel size 201 decreases to the same size of a vapor bubble 202, the expansion of the vapor causes liquid 203 to flow outwards 204, irrespective of the desired flow rate. This phenomena poses a few problems. One problem is that the pressure drop associated with high liquid velocities in a channel are quite high, especially relative to the small available pressure head in a thermosyphon device. A second problem that this phenomena can cause is that the middle of the channel is left dry and can increase in temperature, since the vapor has limited heat capacitance.

SUMMARY

This invention is directed toward thermosyphon technology. Certain embodiments are intended for use in electronics cooling applications, wherein a looped flow pattern through channels is formed by fins in the evaporator as well as in the condenser, while allowing for low pressure loss through these channels, thereby enabling this configuration to be applied in low profile systems where the gravitationally-induced liquid pressure head is limited.

The liquid supplied to the evaporator is intermittent, and passively regulated by the back flow of vapor bubbles. The passively regulated liquid supply enables enhanced solid/liquid/vapor contact, which yields high heat transfer rates on the channels within the evaporator. This characteristic is a solution to the limitations associated with pool boiling in an evaporator flooded with liquid.

Additionally, the problem of flow instabilities of expanding vapor bubbles in confined channels is addressed through a series of minor vapor and liquid distribution channels cutting across the major channels on the surface. These channels help enable the liquid and vapor to be stratified in a confined space, which provides a free path for vapor to escape the evaporator with minimum impedance of the liquid phase. Additionally, the liquid distribution allows for the bottom of the fins to maintain a wetted region, and maintain stable performance.

In various embodiments of the condenser, the vapor flow helps drag liquid along with it from the vapor intake orifices to the liquid exit orifice. The liquid exit orifice is located at the bottom of the fins, which helps minimize the required refrigerant charge as well as keeps the fins free from collected liquid, which can block the condensation process.

The foregoing has outlined rather broadly certain aspects of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 3:
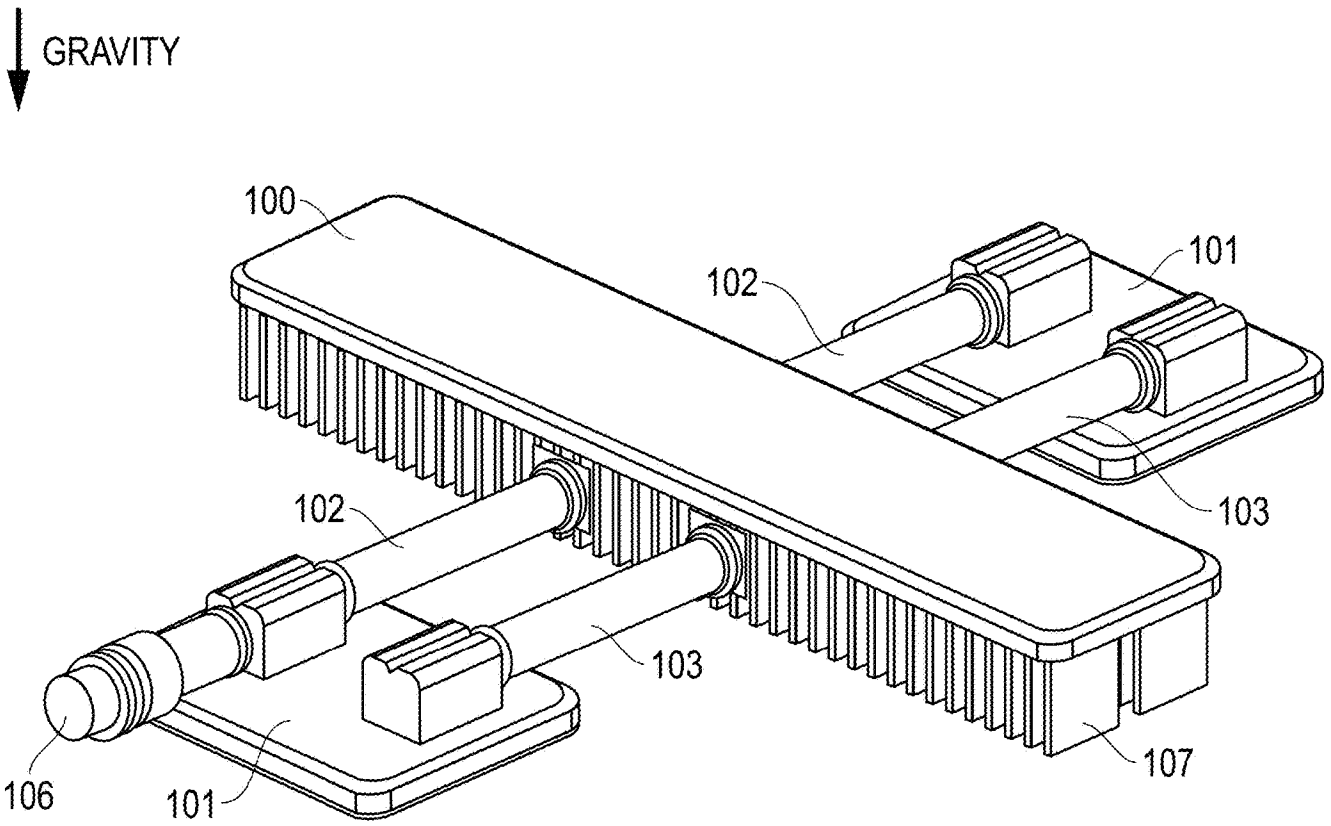
FIG. 3 is a schematic of one embodiment of the thermosyphon of the present invention.

The present invention is directed to an improved intermittent thermosyphon. The configuration and use of the presently preferred embodiments are discussed in detail below. It should be appreciated, however, that the present invention provides many applicable inventive concepts that can be embodied in a wide variety of contexts other than an intermittent thermosyphon. Accordingly, the specific embodiments discussed are merely illustrative of specific ways to make and use the invention, and do not limit the scope of the invention. In addition, the following terms shall have the associated meaning when used herein:

One embodiment of the present invention is presented in FIG. 3. It includes a condenser 100, two evaporators 101, a vapor tube 102 connecting the evaporator 101 to the condenser 100 primarily transferring vapor, a liquid tube 103 connecting the condenser 100 to the evaporator 102 primarily transferring liquid, and an access valve 106, to pull a vacuum, charge and recapture working fluid at production as well as at end of life. The condenser 100 has fins 107 that allow for heat to be rejected to the air passing through. The bottom of the evaporators 101 will contact a heat generating electronics component, such as a central processing unit, through a thermal interface material. The contact surface will require force to be applied through an additional part, which is not detailed, so that adequate pressure may be obtained between the evaporator 101 and the heat generating component. This embodiment is described in detail, however, there may be variants, such as a system with a single evaporator 101, and three or more evaporators 101. In these scenarios, the implementation may require a separate vapor tube 102 and liquid tube 103 to each evaporator 101 in a parallel flow scheme or there is the possibility of using a serial flow scheme.

Figure 4:
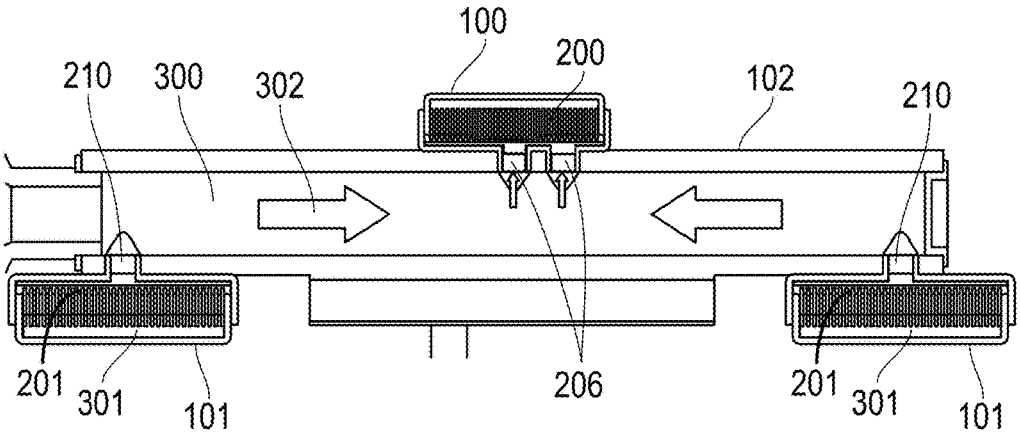
FIG. 4 is a cross-sectional view of one embodiment of the vapor tube of the present invention and a representation of the flow pattern in this tube.

A cross-section of this embodiment through the vapor tube 102 is represented in FIG. 4. The evaporator 101 has fins 201 extending from the bottom surface to the top surface, creating a series of channels, and the fins 201 are partially submerged in liquid 301. The evaporator fins 201 act to increase the heat transfer area as well as provide structural strength to withstand high internal pressures. Vapor 300 exits the evaporator 101 through an orifice 210 and enters the vapor tube 102. Vapor 300, travels through the tube 102 from the evaporator 101 to the condenser 100 in the direction represented by the arrows 302. The axis of the vapor tube 102 generally parallels a horizontal axis. Vapor 300 enters the condenser 100 through two orifices 206 in the bottom of the condenser 100. The condenser 100 also has fins 200 extending from the bottom surface to the top surface, creating a series of channels. The condenser fins 200 also act as a means to increase the heat transfer area as well as provide structural support. When height is limited, as is the case for the embodiment represented, the vapor entry orifices 206 in the condenser 100 may be located on the bottom side. In cases where there is additional space, these orifices 206 may also be located on the top side.

Figure 5:
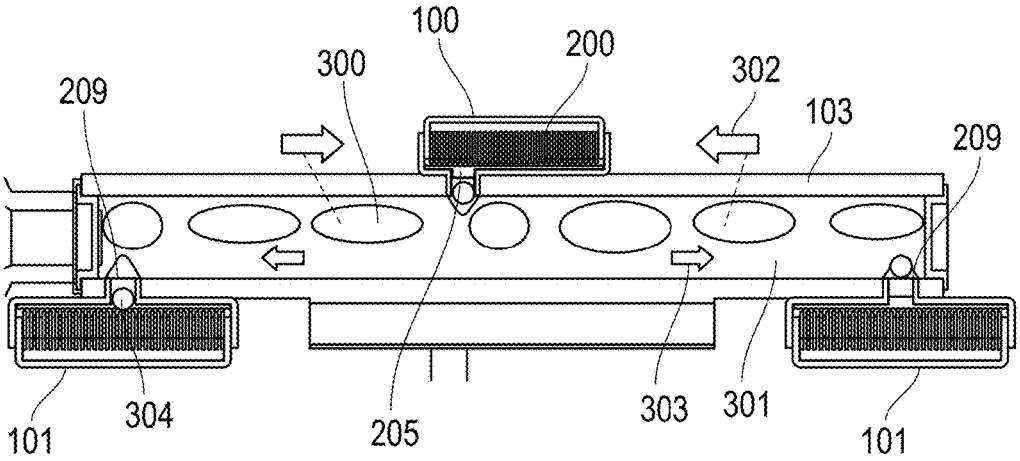
FIG. 5 is a cross-sectional view of one embodiment of the liquid tube of the present invention and a representation of the flow pattern in this tube.

A cross-section of this embodiment through the liquid tube 103 is represented in FIG. 5. The center line of the liquid tube 103 parallels a horizontal axis. The liquid 301 primarily fills up the tube 103. It leaves the condenser 100 through an orifice 205 located on the bottom of the condenser 100. Since gravity forces the liquid 301 to stratify on the bottom half of the condenser 100, allowing for liquid 301 to leave through the bottom of the condenser 100 limits the build-up of liquid 301 inside the condenser 100, both reducing the required refrigerant charge as well as maximizing the exposure of the condenser fins 200 to vapor 300. Liquid 301 travels along the liquid tube 103 and enters the evaporator 101 through an orifice 209, and then distributes onto the floor of the evaporator 101. The flow path of the liquid 301 is depicted by arrows 303. Since the liquid 301 enters the evaporator 101 through an orifice 209 located at the top of the evaporator 101, it competes to allow vapor bubbles 304 to escape the evaporator 101 through this same orifice 209. The vapor bubbles 304 accumulate into larger plugs in the liquid tube 103 and flow back to the condenser 100, and through the liquid orifice 205 in the condenser 100, where the vapor 300 also competes to enter the condenser 100, as liquid 301 exits. Since vapor 300 is accumulated in this tube 103, it is necessary that any tube bends do not prevent significant vapor accumulation, where the vapor plugs may block liquid 301 from returning to the evaporator 101 entirely and cause a dry-out condition.

Figure 6:
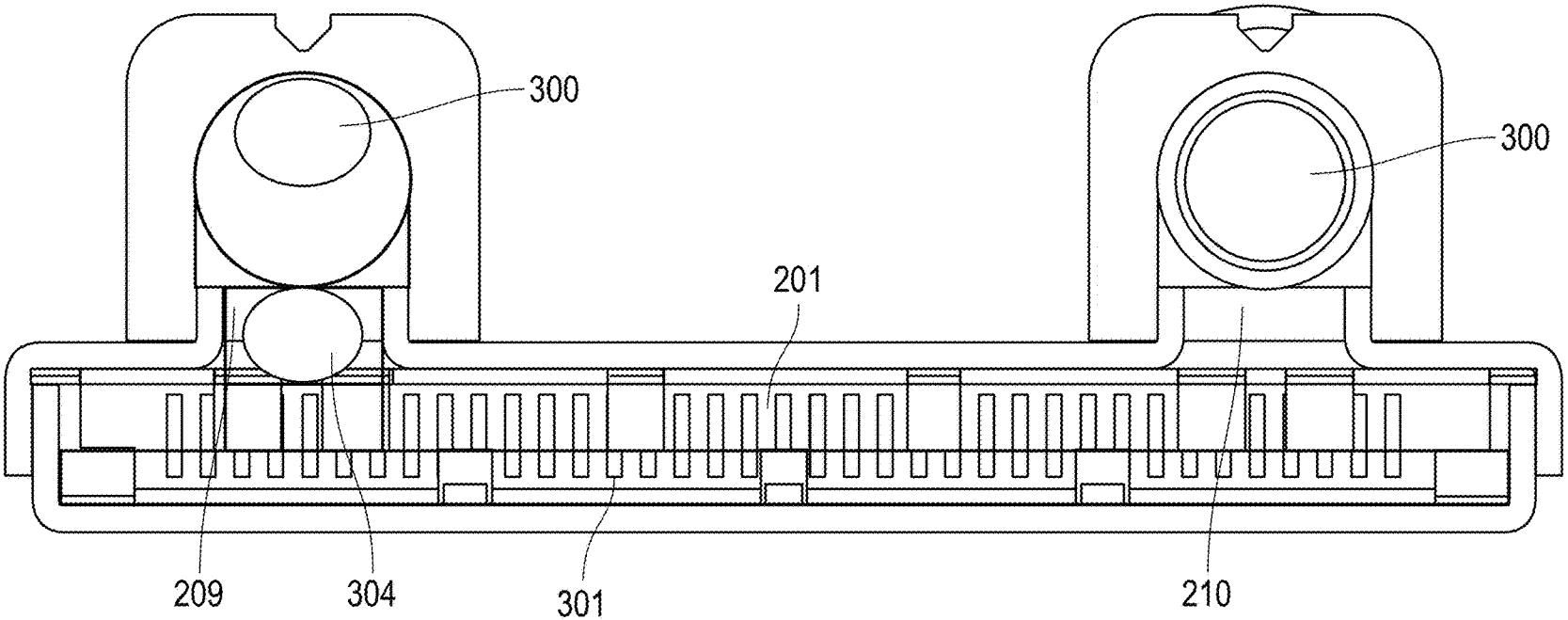
FIG. 6 is a cross-sectional view of one embodiment of the evaporator of the present invention and a representation of the liquid and vapor distribution in this device.

The flow pattern that is produced by the competing flow of the vapor 300 and liquid 301 in liquid tube 103 is intermittent, meaning that liquid 301 is supplied to the evaporator 101 as a series of slugs. This flow pattern is the same behavior that can be observed when turning over a soda bottle and observing the intermittent liquid flow leaving the bottle. Between liquid slugs supplied, there is a liquid starvation period, which must be overcome, which is discussed in a subsequent portion of this section. The liquid starvation period is the duration of time that no liquid is supplied to the evaporator 101. The benefit of the unsteady liquid supply is that the evaporator fins 201 are only partially submerged in liquid 301, allowing maximum solid/liquid/vapor contact and high evaporation heat transfer coefficients. A cross-sectional view showing the liquid 301 stratification in the evaporator 101 is depicted in FIG. 6. Liquid 301 primarily enters the evaporator 101 through an orifice 209 at one end and vapor 300 primarily leaves an orifice 210 at the other end after passing along channels created by fins 201. The backflow of a vapor bubble 304 into the liquid tube 103 is represented as well, since vapor 300 is present on the top half of the evaporator 101.

Figure 1:
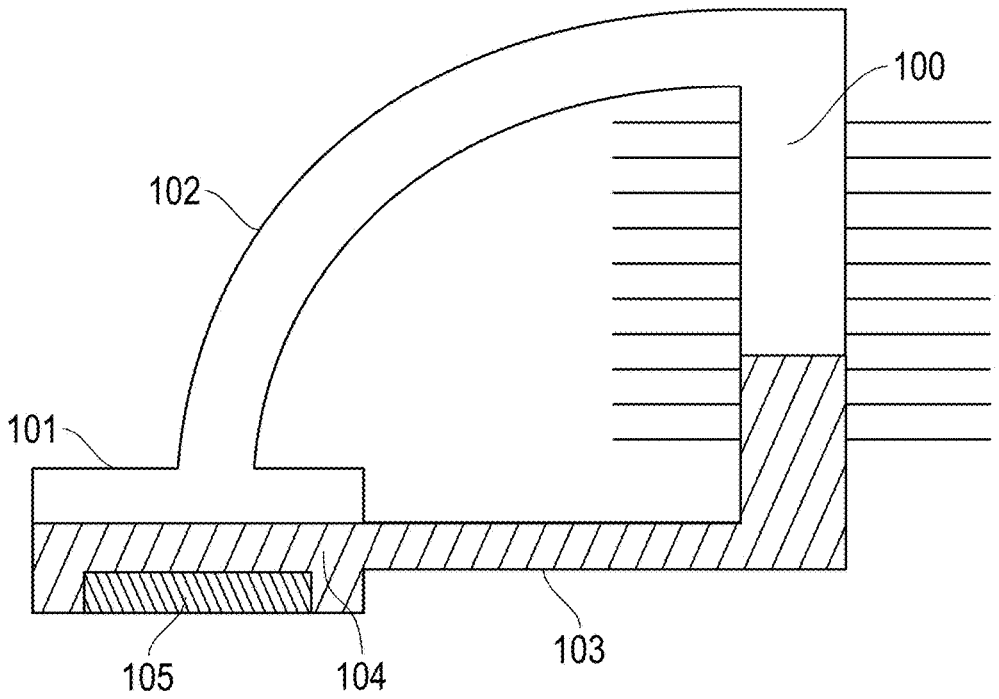
FIG. 1 is a schematic of thermosyphon design in accordance with prior art.
Figure 2:
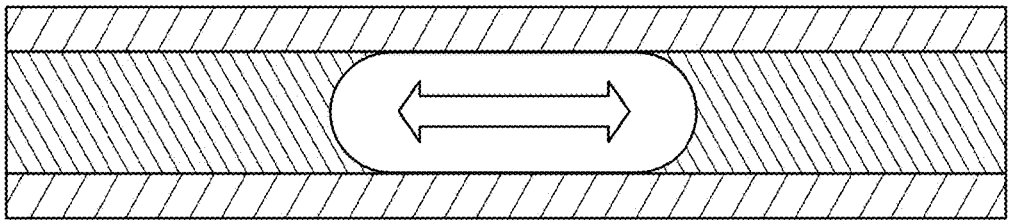
FIG. 2 is a representation of the vapor expansion process in a miniature channel during boiling.
Figure 7:
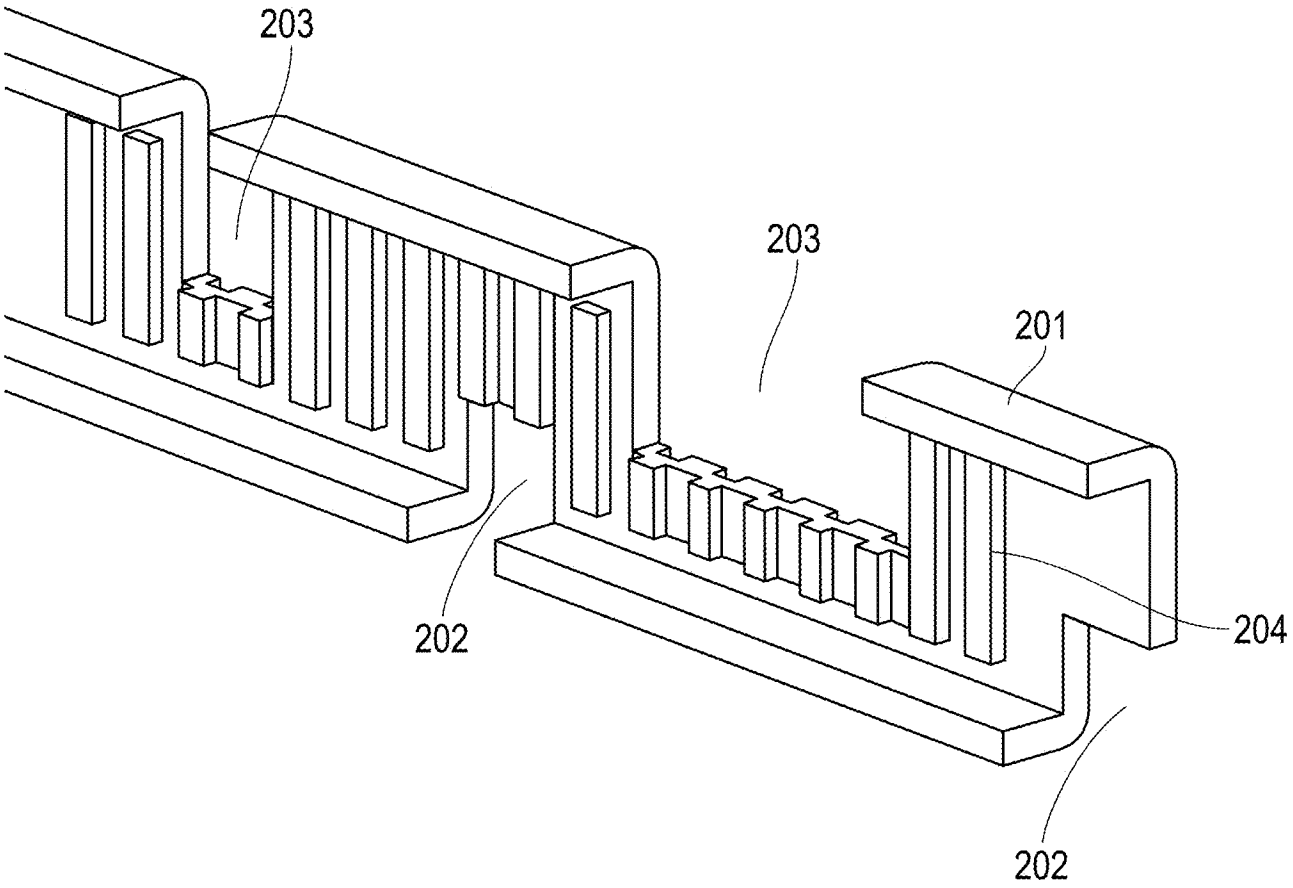
FIG. 7 is a perspective view of one embodiment of a single fin inside of one embodiment of the evaporator of the present invention.

Since liquid 301 and vapor 300 both enter and exit an orifice 209 that is smaller than the width of the evaporator 101, there is a need to allow for liquid 301 to distribute along the base and vapor 300 to collect along the top of the evaporator 101. A close up of an evaporator fin 201 is represented in FIG. 7. This fin 201 has liquid channels 202 that allow liquid 301 to distribute across the fins 201, so that every fin 201 is wet, to allow for evaporation. These channels 202 are repeated along the fins 201, so that liquid 301 can easily distribute throughout the evaporator 101, and help allow liquid 301 to easily flow to parts of the evaporator 101 experiencing a high heat flux. The evaporator fins 201 also have larger channels 203 near the top of the fin 201 to allow for vapor 300 to distribute along the fins 201 and easily flow to the orifice 210. These vapor channels 203 allow for the fin density to increase, while reducing or eliminating the situation where a flow instability may occur due to the rapid expansion of a vapor bubble in a confined space (refer back to FIG. 2 and the explanation in the background section). The combination of the liquid 301 and vapor 300 distribution allow for a steady supply of liquid 301 to the fins 201 as well as a steady removal of vapor 300.

The evaporator may also have vertical ribs 204 imprinted into the fins 201 to form a corner in which liquid 301 may be pulled up by capillarity. As liquid 301 is pulled up, the length of the solid/liquid/vapor contact will increase and provide additional ability to vaporize liquid at low fin temperature elevation over the saturation temperature of the liquid 301 and vapor 300 mixture.

The aforementioned "steady" supply of liquid to the evaporator can be achieved if there is a large enough amount of liquid stored in the evaporator to overcome the unsteady delivery of liquid. The mass, $m_{storage}$, of the liquid stored in the evaporator should be greater than the mass of liquid that is vaporized during the starvation period, $\tau_{starvation}$ as depicted in EQ 1, where the latent heat of vaporization is $h_{fg}$. The higher the maximum heat load, Q, the greater the liquid reservoir that is required.

$$m_{storage} > \frac{Q}{h_{fg}} \tau_{starvation} \quad \text{EQ 1}$$

The concept of liquid storage in the evaporator is very important in many applications, including electronics applications, since the internal volume inside the evaporator is small and the power can be relatively high. There are situations where all the liquid in the evaporator can be vaporized in less than a single second. If the required liquid storage is not properly accounted for, the evaporator can dry-out and lose its functionality.

Figure 8:
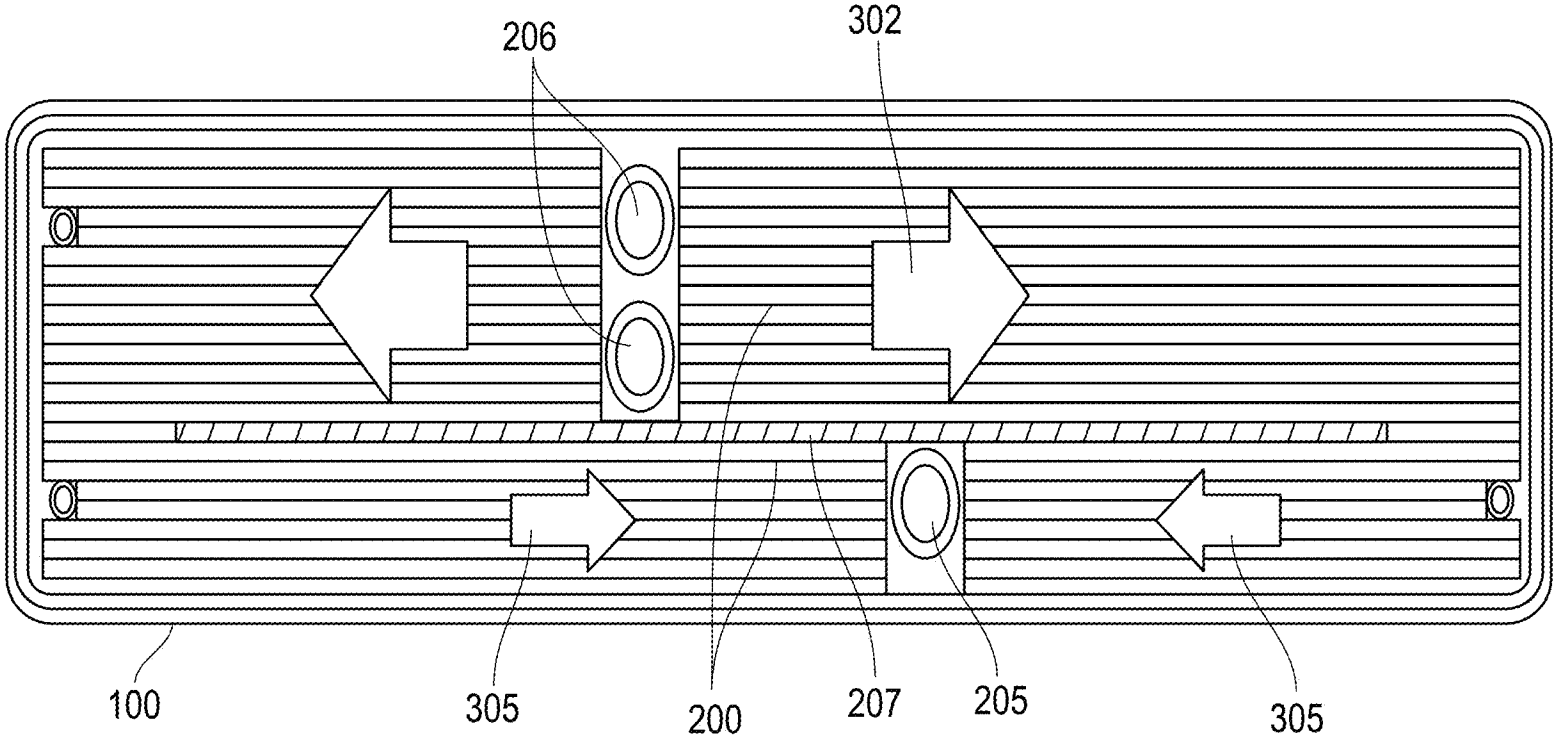
FIG. 8 is a cross-sectional view of one embodiment of the condenser of the present invention and a representation of the flow pattern inside.

While evaporator performance is improved by balancing liquid delivery without flooding or starving the evaporator with liquid, condenser performance is improved by keeping as much of the fins exposed to vapor as possible. A cross-sectional view of the condenser 100 is presented in FIG. 8, in which vapor enters orifices 206 flows outward 302 along the fins 200, cuts through openings 211 (not shown in FIG. 8, but described in detail below) created in the fins 200 and then flows inward 305 to the liquid exiting orifice 205. The vapor helps to push liquid along with it, and prevent too much accumulation of liquid. The outward vapor flow 302 and inward vapor flow 305 are separated by a single fin 207 with openings only located at the far left and far right, as depicted in FIG. 8, forcing vapor to flow as depicted.

The vapor flow pattern within the condenser 100 may be varied, depending on vapor and tube routing requirements, allowable condenser depth and heat source location. For instance, vapor can simply flow from left to right, or even as a "Z" pattern.

Figure 9:
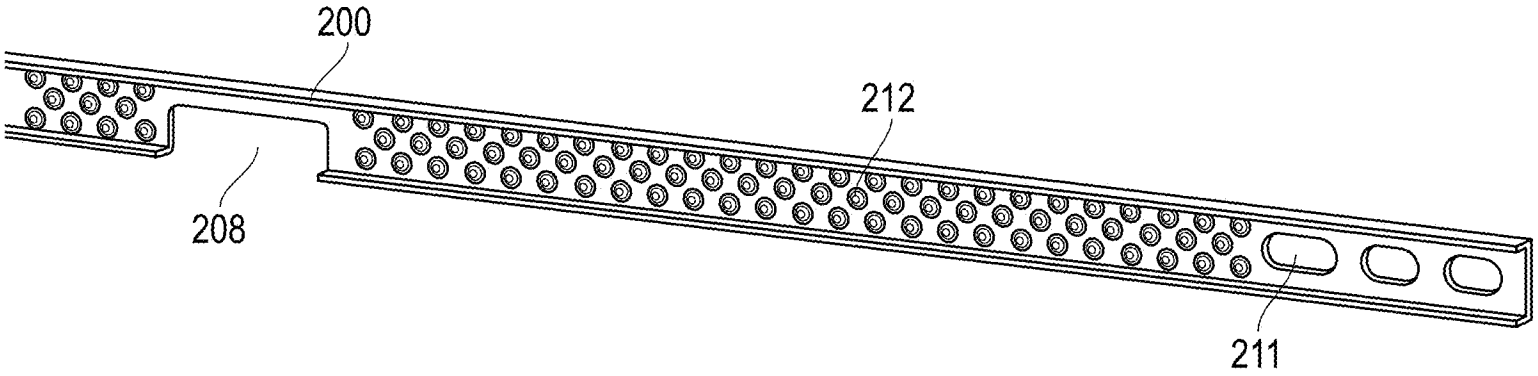
FIG. 9 is a perspective view of a single fin inside one embodiment of the foregoing condenser.

The aforementioned openings 211 in the condenser fin 200 are depicted in FIG. 9. These openings 211 allow vapor to pass through while maintaining structural strength to withstand high internal pressures. At the inlet and outlet orifices, the fin 200 can have a cutout 208 allowing unobstructed vapor distribution (at the inlet) and liquid collection (at the outlet). Additionally, these fins 200 have dimples 212 which provide a means to reduce the thickness of the film of liquid created as vapor condenses on the surface and travels down the fin 200. The dimple 212 creates a convex surface at its peak. The liquid's surface tension, in conjunction with the dimpled surface creates a relatively high capillary pressure. As the dimple 212 gradually merges into the flat surface of the fin 200, the curvature continuously changes from a convex surface to a concave surface to a flat surface. In the regions where the curvature is changing, the capillary pressure changes, causing a pressure gradient in the liquid film. This pressure gradient drives the liquid from the relative high pressure to the relative low pressures and acts as a thinning agent. As the film thickness decreases, so does the temperature difference between the saturation temperature of the liquid and vapor mixture to the cooler fin temperature.

While determining sizing of the internal tube diameters, and maximum supported power, one can use the height difference from the bottom of the condenser to the top of the evaporator as the maximum pumping head potential of the system. The hydrodynamic losses along the tubes, condenser and evaporator may be estimated by determining the velocity of the fluids passing through. Since the flow pattern is transient, an experimental determination of the operating characteristics, such as maximum supported power before liquid cannot return to the evaporator is likely required. The details of the embodiment presented allow for the use of a higher pressure working refrigerant, such as R134a, R1234yf, R1234ze, R410a, or R290, at operating conditions of approximately −10 C to 85 C, which is the approximate range required for most electronics devices. The benefit of higher pressure refrigerants is that the vapor densities are greater, leading to lower vapor velocities and smaller tube diameters. Additionally, the volume of non-condensable gas within the system is compressed and takes up less volume, thereby limiting any adverse effects it may cause. Finally, leaks tend to go outward, and the use of valves may be considered, since the permeation of air through an elastomer O-ring is of minimal concern.

Figure 10:
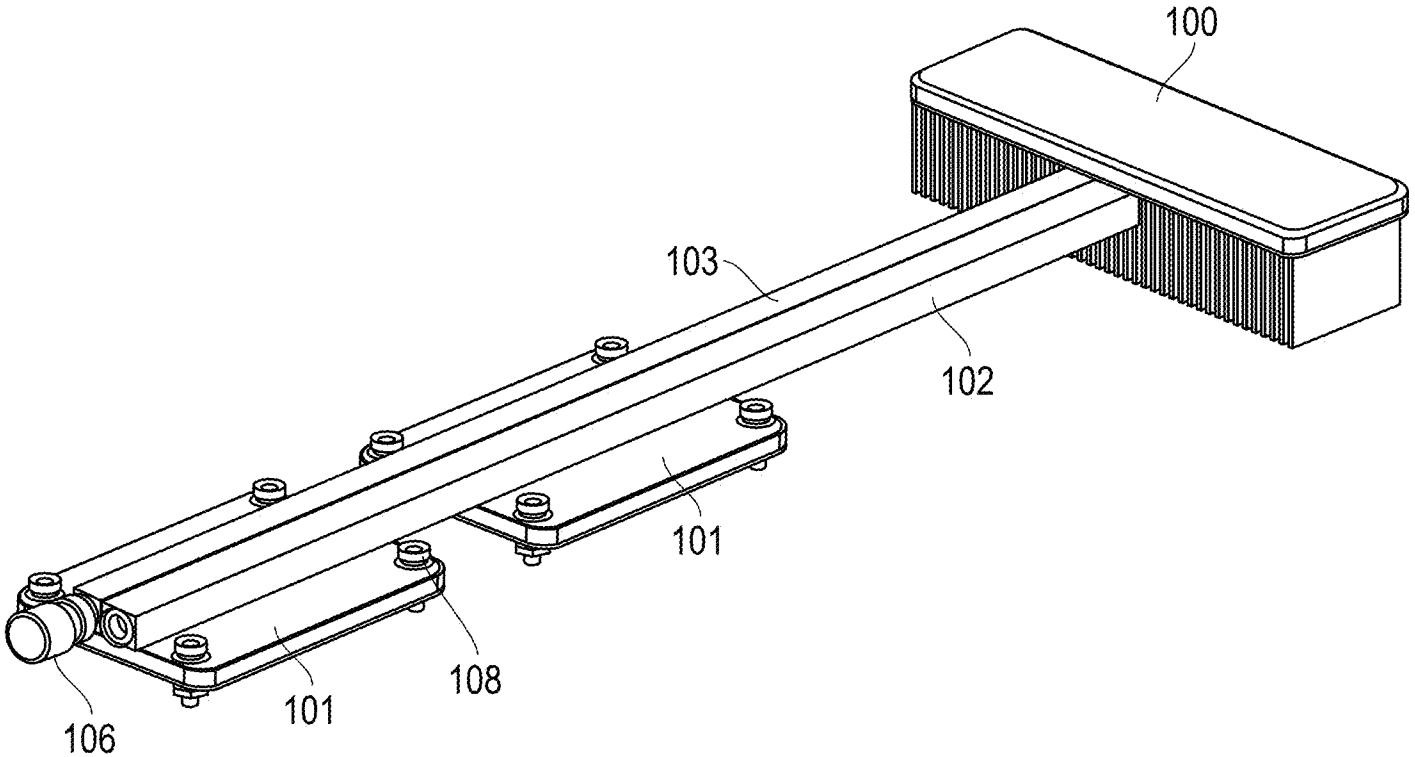
FIG. 10 is an isometric view of another embodiment of the thermosiphon of the present invention.

Another embodiment of the present invention is presented in FIG. 10. This embodiment has a condenser 100, and two evaporators 101 on the same side of the condenser 100. The evaporators 100 are fluidly coupled to the condenser with a vapor tube 102 and a liquid tube 103. Integrated into each evaporator 101 are mounting hardware 108, consisting of springs and screws, to couple the evaporator 101 to a heat generating device.

Figure 11:
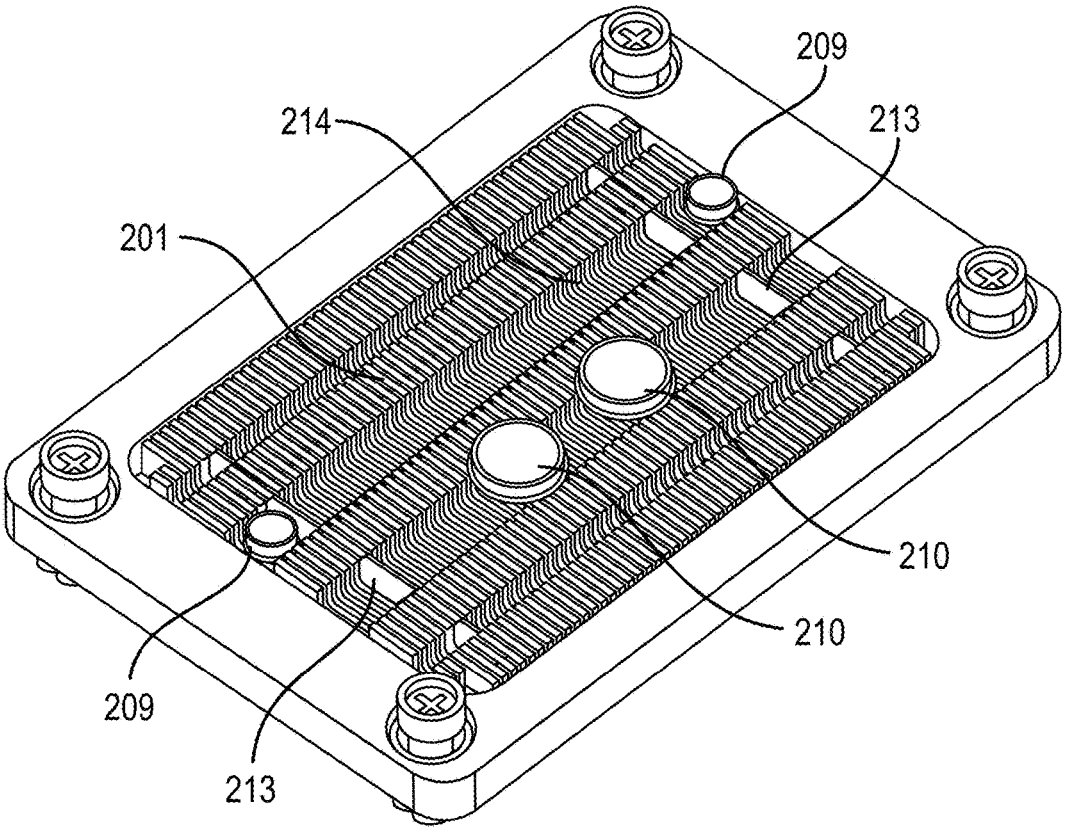
FIG. 11 is an isometric view of the evaporator with a transparent cover in the foregoing embodiment of the present invention.

An isometric view of the evaporator with a transparent top lid 214 is presented in FIG. 11. The lid 214 has two orifices 210 near the center of the lid 214 which allow vapor to enter the vapor tube 102. At the front and rear end of the lid 214 are two additional orifices 209 which allow liquid to enter the evaporator 101 from the liquid tube 103. The use of multiple orifices (209 & 210) reduces pressure loss, which allows more power to be supported with limited liquid gravitational pressure head to drive the flow. In the evaporator 101 is a fin stack 201, creating rectangular channels inside the evaporator with cross-cuts allowing vapor and liquid to flow freely between the channels.

Figure 12:
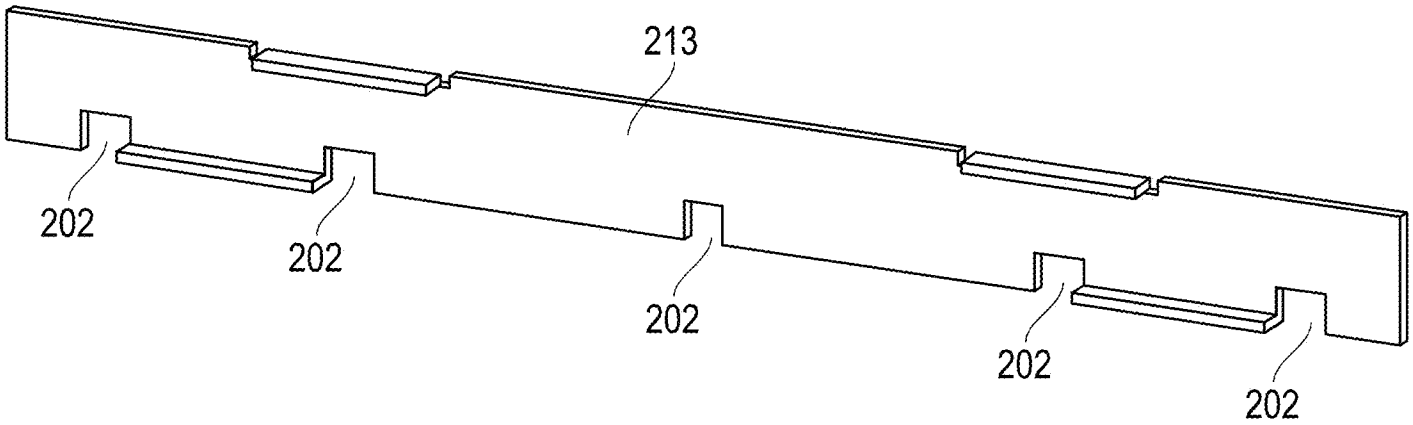
FIG. 12 is a view of a vapor blocking fin inside the foregoing evaporator.

One challenge to this embodiment, in which the two evaporators 101 are serially connected on a single side of the condenser 100, is an increased sensitivity to vapor backflow through the liquid tube 103. This vapor backflow, while in some situations is desired, can impede liquid from reaching the evaporator 101, causing a dry-out situation. To limit the degree in which vapor is allowed to backflow through the liquid tube 102, a vapor blocking fin 213 may be added to the fin stack. A view of the vapor-blocking fin 213 is presented in FIG. 12. Similar to the other evaporator fins 201, the vapor blocking fin 213 has liquid cut-outs 202, allowing liquid to freely pass through. The vapor blocking fin 213 removes the vapor cut-outs 203, limiting or preventing vapor to freely flow past this fin 213. In the space between the two vapor blocking fins 213, the liquid and vapor will be stratified, as vapor tends to stay on the top. In order to better prevent vapor from crossing the vapor blocking fin 213, the height of the liquid cut-outs 202 should be lower than the liquid height inside the evaporator 101.

For a specific application, the design of the vapor blocking fin 213 may be tuned for a specific power range, by partially blocking the vapor cut-outs 203. Another design consideration is the location of the liquid orifices 209 in the evaporator, relative to the vapor orifices 210.

Figure 13:
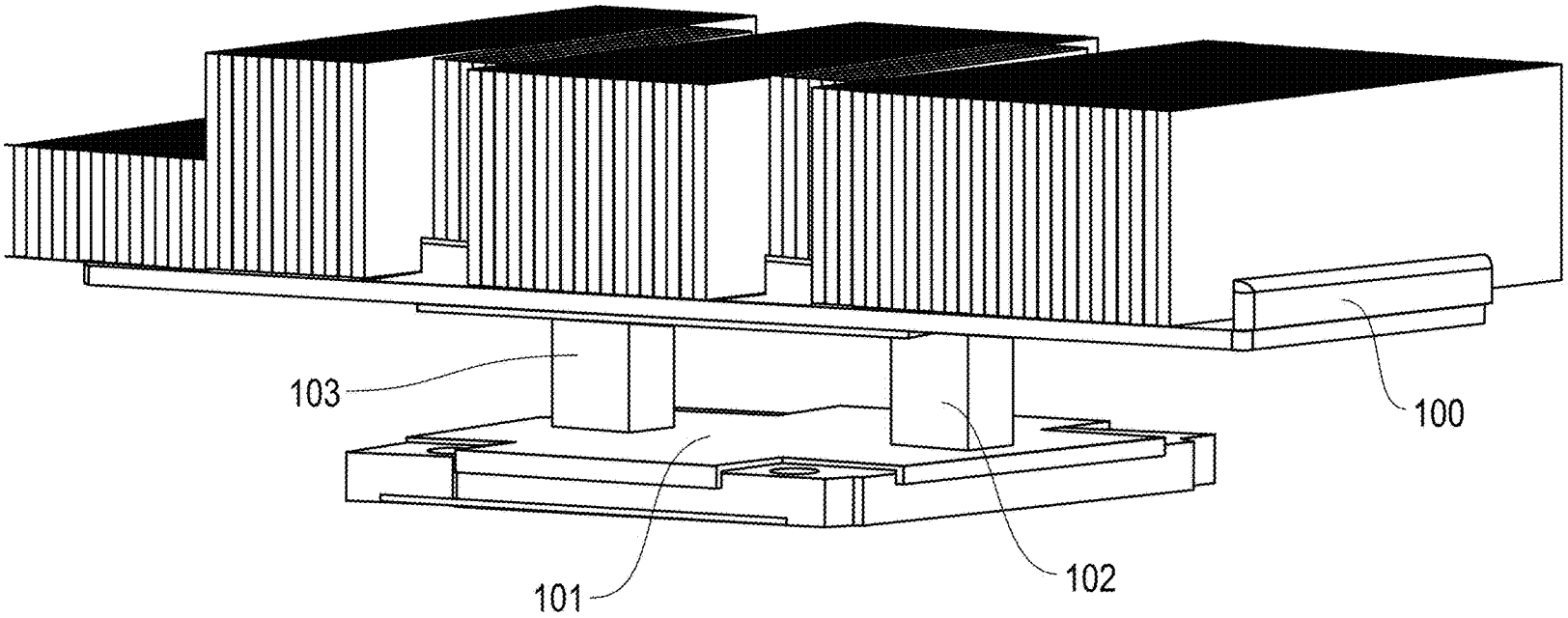
FIG. 13 is an isometric view of another embodiment of the thermosiphon of the present invention.

Yet another embodiment of the present invention is presented in FIG. 13, consisting of an evaporator 101 and a condenser 100 located above the evaporator 101, a vapor channel 102 connecting the evaporator 101 to the condenser 100 and a liquid channel 103 connecting the condenser 100 to the evaporator 101. In some embodiments, the liquid channel 102 and vapor channel 103 generally travel along a horizontal axis. However, in this embodiment, the liquid channel 102 and vapor channel 103 have vertical axes.

Figure 14:
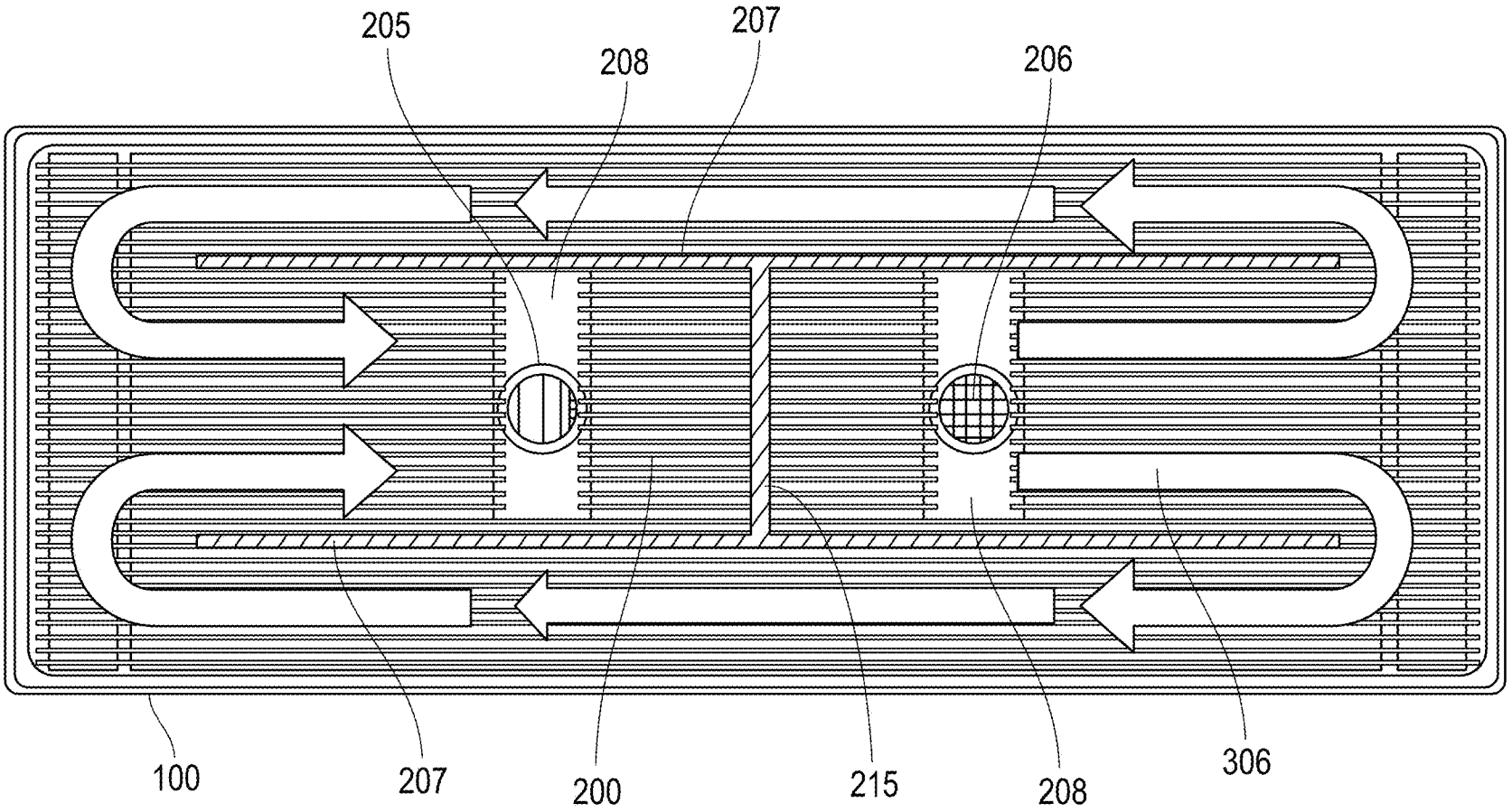
FIG. 14 is a cross-sectional view of the condenser of the foregoing embodiment of the present invention.

A cross section of the condenser 100 of the foregoing embodiment is presented in FIG. 14. This cross-section is located towards the bottom of the condenser fins 200, exposing the cut-outs 208 adjacent to the liquid orifice 205 and vapor orifice 206 in the condenser 100. The fluid flow 306 path inside the condenser 100 travels in a mirrored circular flow pattern. There is a dividing fin 207 that has no cut-outs through the center portion, separating flow that goes in opposite directions. Additionally, there is another added barrier 215 located between the liquid orifice 205 and vapor orifice 206, preventing short-circuiting of the flow inside the condenser 100.

Figure 15:
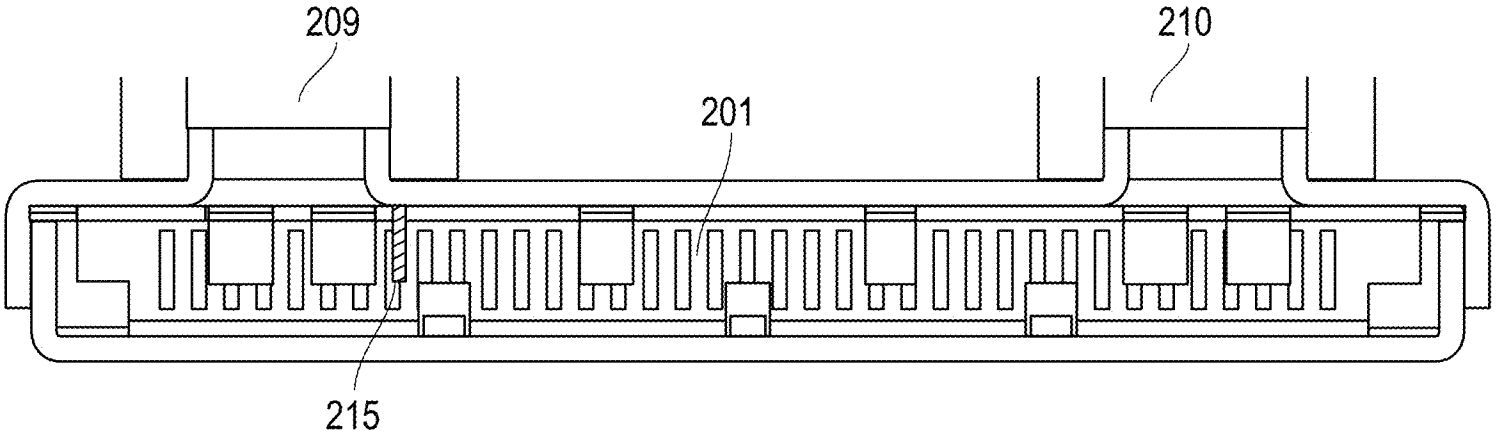
FIG. 15 is a cross-sectional view of the evaporator of the foregoing embodiment of the present invention.

A cross-sectional view of the evaporator 101 of the foregoing embodiment is presented in FIG. 15. In this embodiment, the liquid entry orifice 209 and vapor exit orifice 210 are located along the same channels formed by the evaporator fins 201. The vapor backflow through the liquid orifice 209 is controlled by a solid barrier 215. This barrier 215 blocks the top portion of the channels, but allows the bottom portion of the channels to be open. When the bottom portion of this barrier 215 is below the stratified liquid level inside the evaporator 101, it can limit or prevent vapor backflow. The barrier 215 may extend across all of the channels, or just some of the channels, depending upon the permissible amount of vapor backflow.

Figure 16:
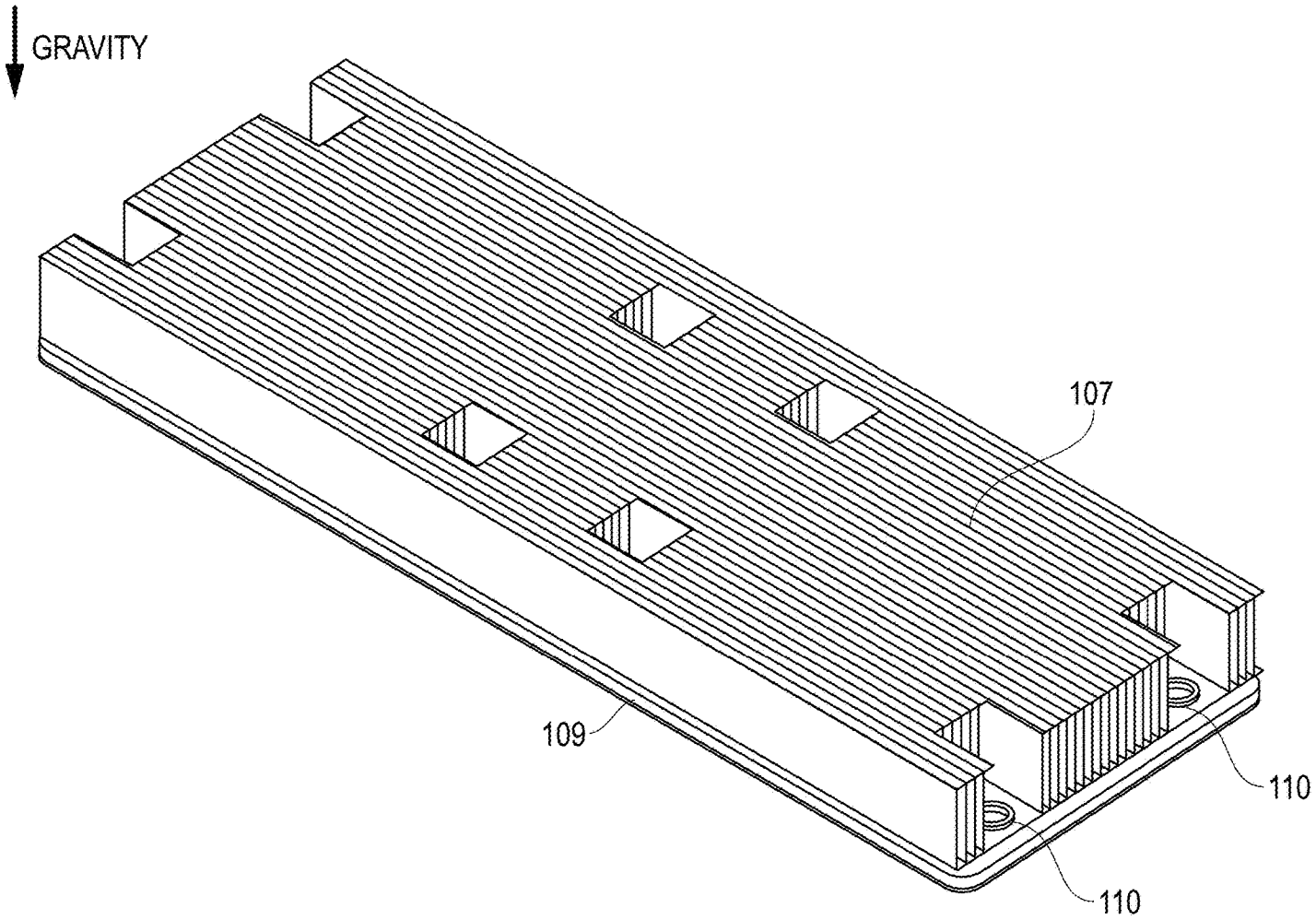
FIG. 16 is an isometric view of another embodiment of the thermosyphon of the present invention.

Another embodiment of the thermosiphon of the present invention is presented in FIG. 16. In this embodiment, the evaporator and condenser are combined into a single evaporator/condenser 109 module. Fins 107 are attached to the evaporator/condenser 109 and allow air to pass through to remove heat. The core of the evaporator/condenser consists of a top piece, a bottom piece and internal fins 216 (not shown in FIG. 16, but described in detail below). The internal fins 216 are bonded to the top and bottom piece, and create internal channels. The internal fins 216 have several cross-cuts allowing liquid and vapor to flow across the channels. Heat is applied through the bottom piece, and removed through the top piece of this embodiment.

Figure 17:
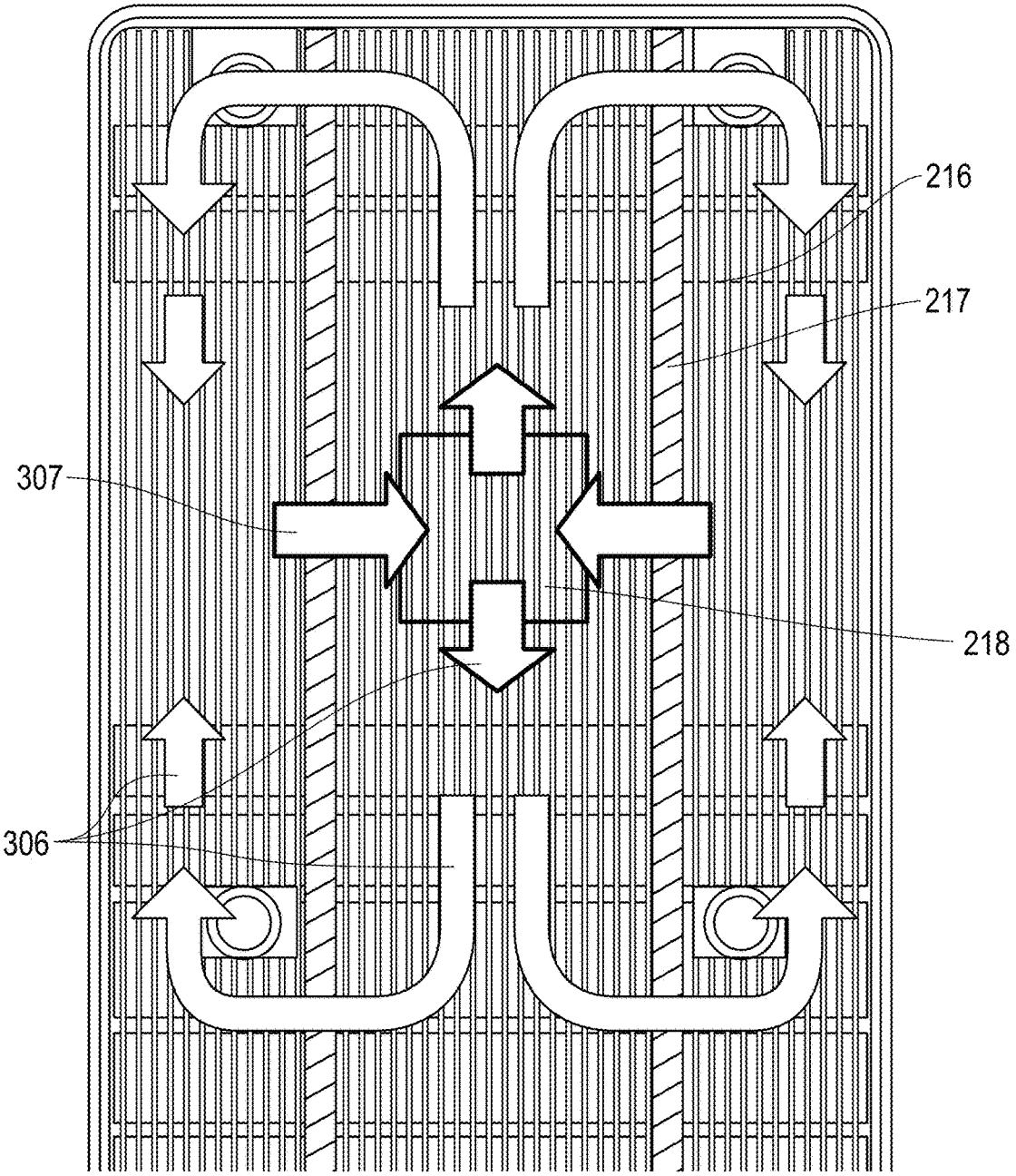
FIG. 17 is a cross-sectional view of the evaporator/condenser of the foregoing embodiment.

A cross-section of the evaporator/condenser 109 is presented in FIG. 17. This cross-section cuts through the internal fins 216. The vapor and liquid flow in the same counter-rotating flow paths 306. In this embodiment, heat is applied to the central region 218 of the bottom piece. The vapor flow 306 starts from this central region 218, as liquid vaporizes as a result of the heat input. Since heat is removed from the entire region, condensation occurs along each and every flow channel. The flow pattern is driven by a flow control fin 217. In the region adjacent to the central region 218, liquid is allowed to flow 307 through the flow control fin 217 through liquid cut-outs 202 while vapor is not. The difference of liquid height on either side of this fin provides the gravitational pressure head needed to circulate the refrigerant flow 306.

Figure 18:
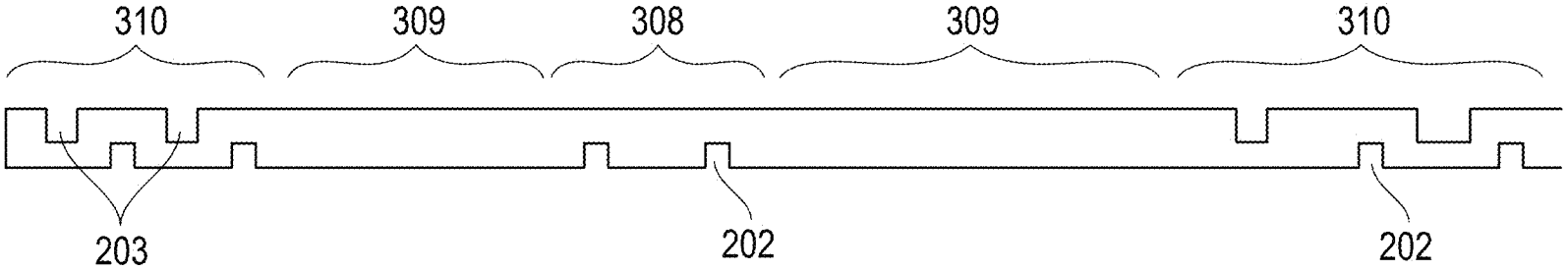
FIG. 18 is a view of the flow control fin inside the evaporator/condenser of the foregoing embodiment.

The flow control fin 217 may be divided up into several regions, which can be designed to dictate how the refrigerant will flow inside the evaporator/condenser 109. A front view of this fin is presented in FIG. 18. The flow control fin 217 is made up in three distinct section types. The liquid cross section 308, has liquid cut-outs 202, but no vapor cut-outs 203, thus only allowing liquid to pass through, since the vapor is stratified towards the top portion of the fin. The second portion is the flow separation region 309. There are no vapor 203 nor liquid cut-outs 202 in this region. The flow separation region 309 allows isolation of countering flow currents. The third region is a flow crossing region 310, which allows both vapor and liquid to pass through their respective cut-outs (202, 203). This region may be utilized to allow the refrigerant flow to change directions.

It is possible to design an evaporator/condenser 109 without a flow control fin 217, however the channel height typically needs to be higher, since liquid and vapor will flow counter to each other, which requires a larger gravitational pressure head to overcome the fluid flow losses.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for an intermittent thermosyphon known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A thermosyphon, comprising:

a condenser having a first condenser orifice through which vapor enters the condenser;

the condenser further having a second condenser orifice through which liquid leaves the condenser;

an evaporator having a first evaporator orifice through which vapor exits the evaporator;

the evaporator further having a second evaporator orifice located below the second condenser orifice through which liquid enters the evaporator, wherein the first evaporator orifice and the second evaporator orifice pass through a planar top interior surface of the evaporator, and the first condenser orifice and the second condenser orifice pass through a planar bottom interior surface of the condenser, a plurality of evaporator fins positioned within the evaporator so that each of the evaporator fins extends from the planar bottom interior surface of the evaporator to the planar top interior surface of the evaporator, wherein the plurality of evaporator fins create flow channels to direct movement of fluid within the evaporator from the second evaporator orifice towards the first evaporator orifice, and wherein a notch removing only an upper portion of one or more of the plurality of evaporator fins positioned proximal to the second evaporator orifice allows liquid entering the evaporator unobstructed access to the flow channels, and further having a plurality of condenser fins positioned within the condenser so that each of the condenser fins extends from the planar bottom interior surface of the condenser to a planar top interior surface of the condenser, wherein the plurality of condenser fins create flow channels to direct movement of fluid within the condenser from the first condenser orifice towards the second condenser orifice;

a vapor tube fluidly coupling the first evaporator orifice to the first condenser orifice; and a liquid tube fluidly coupling the second condenser orifice to the second evaporator orifice.

2. The thermosyphon of claim 1, wherein the flow channels are located between the condenser fins, and fluid within the condenser is permitted to flow only through the flow channels.

3. The thermosyphon of claim 1, wherein the plurality of condenser fins are oriented laterally, with lateral flow channels therebetween, with each condenser fin having one or more openings positioned adjacent to a lateral end thereof, wherein vapor enters the condenser through the first condenser orifice and travels laterally through a first set of flow channels from the first condenser orifice towards the one or more openings positioned adjacent to the lateral end of the plurality of condenser fins, and wherein the one or more openings positioned adjacent to the lateral end of the condenser fins allow the vapor and its condensate to pass longitudinally through the one or more openings in the condenser fins from the first set of flow channels to a second set of flow channels through which the vapor and its condensate can pass through a notch to access the second condenser orifice.

4. The thermosyphon of claim 3, wherein a notch removing only a lower portion of one or more of the plurality of condenser fins positioned proximal to the second condenser orifice forming the first set of flow channels proximal to the first condenser orifice allows liquid leaving the condenser through the flow channels unobstructed access to the second condenser orifice.

5. The thermosyphon of claim 3, wherein a notch in the condenser fins forming the second set of flow channels positioned proximal to the second condenser orifice allows liquid condensate leaving the condenser an unobstructed pathway from any of the second set of flow channels.

6. The thermosyphon of claim 1, wherein the condenser fins are configured with a texture to alter the pressure gradient of a liquid film on the condenser fins thereby facilitating condensation.

7. The thermosyphon of claim 1, where the liquid tube and the vapor tube are substantially horizontal when in use.

8. The thermosyphon of claim 1, where the first condenser orifice is located on the same plane as the second condenser orifice.

9. The thermosyphon of claim 1, wherein the plurality of evaporator fins positioned within the evaporator are oriented laterally with each evaporator fin having one or more openings therethrough, wherein liquid enters the evaporator through the second evaporator orifice, wherein vapor leaves the evaporator through the first evaporator orifice, and wherein the plurality of evaporator fins are configured to allow the liquid and the vapor to pass longitudinally through openings in the evaporator fins.

10. The thermosyphon of claim 1, wherein the plurality of evaporator fins positioned within the evaporator are oriented laterally with flow channels therebetween, wherein liquid enters the evaporator through the second evaporator orifice, wherein vapor leaves the evaporator through the first evaporator orifice, and wherein there is a vapor flow barrier positioned longitudinally between the first evaporator orifice and the second evaporator orifice, the vapor flow barrier configured so that the lower portion of the flow channels are open for liquid to flow laterally through the flow channels.

11. The thermosyphon of claim 1, wherein the plurality of evaporator fins positioned within the evaporator are oriented laterally with flow channels therebetween, wherein liquid enters the evaporator through the second evaporator orifice, wherein vapor leaves the evaporator through the first evaporator orifice, and wherein there is a flow barrier positioned longitudinally between the first evaporator orifice and the second evaporator orifice, wherein the flow barrier is configured to force the liquid and the vapor to flow laterally through the flow channels.

12. The thermosyphon of claim 1, wherein the plurality of evaporator fins positioned within the evaporator are oriented laterally with flow channels therebetween, wherein liquid enters the evaporator through the second evaporator orifice and flows through a first portion of the flow channels, wherein vapor leaves the evaporator through a first evaporator orifice and flows through a second portion of the flow channels, wherein both the evaporator fins forming the first portion of flow channels and the evaporator fins forming the second portion of flow channels are configured to allow the liquid to pass longitudinally through openings in the bottom of evaporator fins, and wherein the evaporator fins forming the second portion of the flow channels are configured to allow vapor to pass longitudinally through openings in the middle or top of the evaporator fins.

13. The thermosyphon of claim 1, wherein the plurality of evaporator fins positioned within the evaporator are oriented laterally, wherein liquid enters the evaporator through the second evaporator orifice and flows through a first portion of the flow channels, wherein vapor leaves the evaporator through a first evaporator orifice and flows through a second portion of the flow channels, wherein both the evaporator fins forming the first portion of flow channels and the evaporator fins forming the second portion of flow channels are configured to allow the liquid to pass longitudinally through openings in the bottom of evaporator fins, and wherein the evaporator fins forming the second portion of the flow channels are configured to allow vapor to pass longitudinally through openings in the middle or top of the evaporator fins, and wherein there is at least one evaporator fin between the first portion of the flow channels and the second portion of flow channel that has openings at the bottom of the evaporator fin allowing the liquid to pass through, the at least one evaporator fin being further configured without openings in the middle or top thereof, thereby preventing vapor from passing therethrough.

14. The thermosyphon of claim 1, wherein the evaporator fins are configured with a texture to alter pressure of a liquid film on the evaporator fins thereby facilitating evaporation.

15. The thermosyphon of claim 1, further having at least one additional evaporator fluidly coupled to the condenser through the vapor tube and the liquid tube.

16. The thermosyphon of claim 1, wherein the notch is rectangular in shape.

17. The thermosyphon of claim 1, further having a notch removing only a lower portion of one or more of the plurality of condenser fins positioned proximal to the first condenser orifice that allows vapor entering the condenser unobstructed access to the flow channels.

18. The thermosyphon of claim 1, further having a notch removing only an upper portion of one or more of the plurality of evaporator fins positioned proximal to the first evaporator orifice that allows vapor exiting the evaporator unobstructed access to the first evaporator orifice.

19. A thermosyphon, comprising:

a condenser having a first condenser orifice through which vapor enters the condenser;

the condenser further having a second condenser orifice through which liquid leaves the condenser;

an evaporator having a first evaporator orifice through which vapor exits the evaporator;

the evaporator further having a second evaporator orifice located below the second condenser orifice through which liquid enters the evaporator;

the evaporator further having a planar top interior surface parallel to a planar bottom interior surface, wherein the first evaporator orifice and the second evaporator orifice pass through the planar top interior surface of the evaporator, the first condenser orifice and the second condenser orifice pass through a planar bottom interior surface of the condenser, and the planar top interior surface of the evaporator is parallel to the planar bottom interior surface of the condenser;

a plurality of evaporator fins positioned within the evaporator so that each of the evaporator fins extends from the planar bottom interior surface to the planar top interior surface, wherein the evaporator fins form a flow channel to direct movement of fluid within the evaporator from the second evaporator orifice towards the first evaporator orifice, and wherein a notch removing only an upper portion of one or more of the plurality of evaporator fins positioned proximal to the second evaporator orifice allows liquid entering the evaporator unobstructed access to the flow channels and further having a plurality of condenser fins positioned within the condenser so that each of the condenser fins extends from the planar bottom interior surface of the condenser to a planar top interior surface of the condenser, wherein the plurality of condenser fins form a flow channel to direct movement of fluid within the condenser from the first condenser orifice towards the second condenser orifice;

a vapor tube fluidly coupling the first evaporator orifice to the first condenser orifice; and a liquid tube fluidly coupling the second condenser orifice to the second evaporator orifice.

* * * * *